US010147363B2

(12) United States Patent
Kim et al.

(10) Patent No.: US 10,147,363 B2
(45) Date of Patent: Dec. 4, 2018

(54) TIMING CONTROLLER, DISPLAY DEVICE INCLUDING SAME AND METHOD OF DRIVING DISPLAY DEVICE

(71) Applicant: SAMSUNG DISPLAY CO., LTD., Yongin-si, Gyeonggi-do (KR)

(72) Inventors: Hongsoo Kim, Anyang-si (KR); Geunjeong Park, Daegu (KR); Yunki Baek, Suwon-si (KR); Donggyu Lee, Seoul (KR); Jakyoung Jin, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 153 days.

(21) Appl. No.: 15/163,620

(22) Filed: May 24, 2016

(65) Prior Publication Data

US 2017/0098418 A1 Apr. 6, 2017

(30) Foreign Application Priority Data

Oct. 1, 2015 (KR) ..... 10-2015-0138720

(51) Int. Cl.
*G09G 3/34* (2006.01)
*G09G 3/36* (2006.01)

(52) U.S. Cl.
CPC ..... *G09G 3/3406* (2013.01); *G09G 3/3607* (2013.01); *G09G 2310/08* (2013.01);
(Continued)

(58) Field of Classification Search
CPC ..... G09G 3/3406; G09G 3/36–3/3696; G09G 2310/08; G09G 2320/041; G09G 2320/0242
(Continued)

(56) References Cited

U.S. PATENT DOCUMENTS 8,896,508 B2 * 11/2014 Matsumoto ..... G09G 3/2025 345/602
2007/0152945 A1 * 7/2007 Park ..... G09G 3/3413 345/98
(Continued)

FOREIGN PATENT DOCUMENTS

KR 10-2005-0095443 A 9/2005
KR 10-2005-0101060 A 10/2005
(Continued)

OTHER PUBLICATIONS

Chen, C. et al., A Field Sequential Color LCD Based on Color Fields Arrangement for Color Breakup and Flicker Reduction, Journal of Display Technology, 2009, pp. 34-39, vol. 5, No. 1, IEEE.
(Continued)

*Primary Examiner* — Michael Pervan
(74) *Attorney, Agent, or Firm* — Lewis Roca Rothgerber Christie LLP

(57) ABSTRACT

A timing controller includes: a temperature sensor to sense an ambient-3.6 temperature; a memory to store a liquid crystal response time corresponding to the temperature, and a gamma signal corresponding to the ambient temperature; a field number determinator to identify the liquid crystal response time corresponding to the ambient temperature from the memory, and to determine a number of fields corresponding to the liquid crystal response time; and a gamma converter to identify the gamma signal corresponding to the ambient temperature and the number of fields from the memory, and to convert an image signal into an image data signal corresponding to the gamma signal.

19 Claims, 10 Drawing Sheets

(52) U.S. Cl.
CPC ..... *G09G 2320/0233* (2013.01); *G09G 2320/0242* (2013.01); *G09G 2320/041* (2013.01); *G09G 2330/021* (2013.01)

(58) Field of Classification Search
USPC ..... 345/101, 691–693
See application file for complete search history.

(56) References Cited

U.S. PATENT DOCUMENTS

2007/0285377 A1* 12/2007 Yamazaki ..... G09G 3/3648 345/101
2010/0289731 A1* 11/2010 Matsumoto ..... G09G 3/2025 345/87
2012/0320107 A1* 12/2012 Murakami ..... G02F 1/133603 345/690

FOREIGN PATENT DOCUMENTS

KR 10-2007-0100992 A 10/2007
KR 10-2015-0022160 A 3/2015

OTHER PUBLICATIONS

Lin, F. et al., Color Breakup Reduction by 180 Hz Stencil—FSC Method in Large-Sized Color Filter-Less LCDs, Journal of Display Technology, 2010, pp. 107-112, vol. 6, No. 3, IEEE.
Cheng, H. et al., Color Breakup Suppression in Field-Sequential Five-Primary-Color LCDs, Journal of Display Technology, 2010, pp. 229-234, vol. 6, No. 6, IEEE.
Lin, F. et al., Image Saturation Improvement for 180 Hz Stencil—FSC LCD with Side-Lit LED Backlight, Journal of Display Technology, 2012, pp. 699-706, vol. 8, No. 12, IEEE.

* cited by examiner

FIG. 4

| | Driving Mode | Minimum Driving Frequency | One Field Period (ms) | Liquid Crystal Response Time (ms) |
|---|---|---|---|---|
| 3 Field | RGB | 180Hz | 5.56 | 4.56 |
| 4 Field | RGBW, RGBY, RGBC, RGBM, etc | 240Hz | 4.17 | 3.17 |
| 5 Field | RGBYC, RGBMC, RGBYM, etc | 300Hz | 3.33 | 2.33 |
| 6 Field | RGBKKK, RKGKBK, etc | 360Hz | 2.78 | 1.78 |

FIG. 6

250

| Temperature | Liquid Crystal Response Time(CR) |
|---|---|
| 0℃ | 4.00 |
| 2℃ | 3.95 |
| 4℃ | 3.96 |
| ⋮ | ⋮ |
| 50℃ | 3.56 |

TIMING CONTROLLER, DISPLAY DEVICE INCLUDING SAME AND METHOD OF DRIVING DISPLAY DEVICE

CROSS-REFERENCE TO RELATED APPLICATION

This U.S. non-provisional patent application claims priority to and the benefit of Korean Patent Application No. 10-2015-0138720, under 35 U.S.C. § 119, filed on Oct. 1, 2015 in the Korean Intellectual Property Office (KIPO), the entire content of which is hereby incorporated by reference.

BACKGROUND

1. Field

One or more aspects of example embodiments of the present disclosure herein relate to a timing controller, a display device including the same, and a method of driving the display device.

2. Description of the Related Art

A non-emissive display device, such as a liquid crystal display (LCD), includes a backlight unit (e.g., a backlight source) for supplying light to a display panel, because the display panel itself does not emit light when displaying a image. The backlight unit may employ a light emitting diode (LED), instead of a cold cathode fluorescent lamp (CCFL), to enhance color reproduction and decrease power consumption.

To enhance the quality of a displayed image, a display device that employs a field sequential color driving technique has been proposed. The field sequential color driving technique sequentially drives the light sources of three primary colors (e.g., red, green, and blue) without using color filters (e.g., red, green, and blue color filters), to display a color by using an afterimage by human eyes. Because the display device that employs the field sequential color driving technique has no color filter, the transmittance of light is enhanced and color reproduction is excellent.

The above information disclosed in this Background section is for enhancement of understanding of the background of the inventive concept, and therefore, it may contain information that does not constitute prior art.

SUMMARY

One or more aspects of example embodiments of the present disclosure are directed toward a timing controller that may enhance display quality.

One or more aspects of example embodiments of the present disclosure are directed toward a display device that includes a timing controller capable of enhancing display quality.

One or more aspects of example embodiments of the present disclosure are directed toward a method of driving a display device that is capable of enhancing display quality.

According to an example embodiment of the inventive concept, a timing controller includes: a temperature sensor configured to sense an ambient temperature; a memory configured to store a liquid crystal response time corresponding to the ambient temperature, and a gamma signal corresponding to the ambient temperature; a field number determinator configured to identify the liquid crystal response time corresponding to the ambient temperature from the memory, and to determine a number of fields corresponding to the liquid crystal response time; and a gamma converter configured to identify the gamma signal corresponding to the ambient temperature and the number of fields from the memory, and to convert an image signal into an image data signal corresponding to the gamma signal.

The memory may include: a first memory configured to store the liquid crystal response time corresponding to the ambient temperature; and a second memory configured to store the gamma signal corresponding to the ambient temperature.

The temperature sensor may be configured to sense the ambient temperature at a time interval.

The field number determinator may be configured to change the number of fields, when a variation of the liquid crystal response time identified from the memory exceeds a time boundary range.

The field number determinator may be configured to change the number of fields to k+1, when a current number of fields is k and the liquid crystal response time identified from the memory is longer than an upper time boundary value corresponding to the current number of fields.

The field number determinator may be configured to change the number of fields to k, when a current number of fields is k+1 and the liquid crystal response time identified from the memory is shorter than a lower time boundary value corresponding to the current number of fields.

The gamma converter may be configured to identify the gamma signal corresponding to the ambient temperature and the number of fields from the memory, and to convert the image signal into the image data signal corresponding to the gamma signal, when a variation in the ambient temperature exceeds a temperature boundary range.

The gamma converter may be configured to identify the gamma signal corresponding to the ambient temperature and the number of fields from the memory, and to convert the image signal into the image data signal corresponding to the gamma signal, when the ambient temperature becomes higher than an upper temperature boundary value corresponding to a current gamma signal.

The gamma converter may be configured to identify the gamma signal corresponding to the ambient temperature and the number of fields from the memory, and to convert the image signal into the image data signal corresponding to the gamma signal, when the ambient temperature becomes lower than a lower temperature boundary value corresponding to a current gamma signal.

The timing controller may further include a backlight controller configured to output a backlight control signal for controlling a backlight source in response to the number of fields.

The number of fields corresponding to the liquid crystal response time may be included as the number of fields of one frame.

According to an example embodiment of the inventive concept, a display device includes: a display panel; a driver configured to receive an image signal and a control signal, to convert the image signal into a data signal to enable an image to be displayed on the display panel, and to output a backlight control signal; and a backlight source configured to provide light to the display panel in response to the backlight control signal, the driver including a timing controller, and the timing controller including: a temperature sensor configured to sense an ambient temperature; a memory configured to store a liquid crystal response time corresponding to the ambient temperature, and a gamma signal corresponding to the ambient temperature; a field number determinator configured to identify the liquid crystal response time corresponding to the ambient temperature from the memory, and to determine a number of fields corresponding to the liquid crystal response time; and a gamma converter configured to identify the gamma signal corresponding to the ambient temperature and the number of fields from the memory, and to convert the image signal into an image data signal corresponding to the gamma signal.

The memory may include: a first memory configured to store the liquid crystal response time corresponding to the ambient temperature; and a second memory configured to store the gamma signal corresponding to the ambient temperature.

The field number determinator may be configured to change the number of fields, when a variation of the liquid crystal response time identified from the memory exceeds a time boundary range.

The gamma converter may be configured to identify the gamma signal corresponding to the ambient temperature and the number of fields from the memory, and to convert the image signal into the image data signal corresponding to the gamma signal, when a variation in ambient temperature exceeds a temperature boundary range.

The timing controller may further include a backlight controller configured to output the backlight control signal for controlling the backlight source in response to the number of fields.

The display panel may include a plurality of sub pixels connected to a plurality of gate lines and to a plurality of data lines, and the driver may further include: a gate driver configured to drive the plurality of gate lines; and a data driver configured to drive the plurality of data lines.

The timing controller may be configured to: output a first control signal and a second control signal in response to the control signal; and provide the image signal and the first control signal to the data driver, and the second control signal to the gate driver.

According to an example embodiment of the inventive concept, a method of driving a display device including a display panel, includes: sensing an ambient temperature; storing, in a memory, a liquid crystal response time corresponding to the ambient temperature, and a gamma signal corresponding to the ambient temperature; identifying the liquid crystal response time corresponding to the ambient temperature from the memory; determining a number of fields corresponding to the liquid crystal response time; identifying the gamma signal corresponding to the ambient temperature and the number of fields from the memory; and converting an image signal into an image data signal corresponding to the gamma signal, to provide the image data signal to the display panel.

The display device may further include a backlight source, and the method may further include outputting a backlight control signal for controlling the backlight source in response to the number of fields.

BRIEF DESCRIPTION OF THE DRAWINGS

The above and other aspects and features of the inventive concept will become more apparent to those skilled in the art from the following detailed description of the example embodiments with reference to the accompanying drawings. In the drawings:

FIG. 4 is a table illustrating a liquid crystal response time according to the number of fields in the filed sequential color driving technique through control of red, green, and blue light sources in FIG. 3;

FIG. 6 is a table illustrating a liquid crystal response time corresponding to an ambient temperature that is stored in a first memory in FIG. 5;

DETAILED DESCRIPTION

Figure 1:
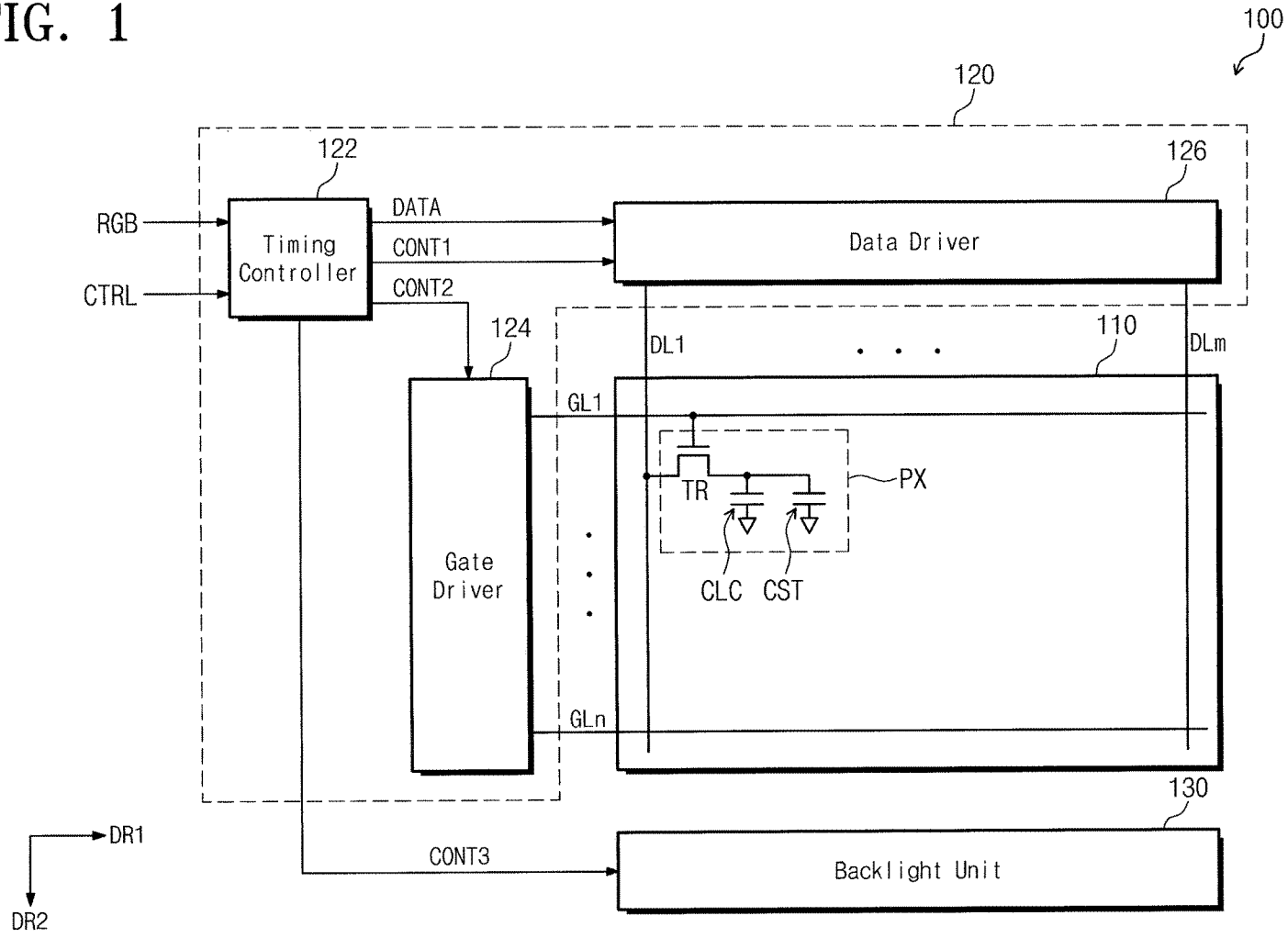
FIG. 1 is a block diagram of a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

FIG. 1 is a block diagram of a display device according to an embodiment of the inventive concept.

Referring to FIG. 1, a display device 100 includes a display panel 110, a driving unit (e.g., a driver) 120, and a backlight unit (e.g., a backlight source) 130. The display device 100 may operate by using a field-sequential color driving technique.

The display panel 110 displays an image. Although the display panel 110 is described as, for example, a liquid crystal display panel, the present inventive concept is not limited thereto, and the display panel may include any suitable display panel that may use the backlight unit 130.

The display panel 110 includes a plurality of gate lines GL1 to GLn extending in a first direction DR1, a plurality of data lines DL1 to DLm extending in a second direction DR2, and a plurality of pixels PX arranged at crossing regions where the plurality of gate lines GL1 to GLn crosses with the plurality of data lines DL1 to DLm. The plurality of data lines DL1 to DLm and the plurality of gate lines GL1 to GLn are insulated from each other. Each of the pixels PX includes a thin film transistor TR, a liquid crystal capacitor CLC, and a storage capacitor CST.

Each of the plurality of pixels PX may have the same or substantially the same structure. Thus, a structure of one pixel (e.g., a first pixel of a first row and a first column) is described hereinafter, and the description of other pixels PX are omitted.

The thin film transistor TR of the pixel PX includes a gate electrode connected to a corresponding gate line GL (e.g., a first gate line GL1) of the plurality of gate lines GL1 to GLn, a source electrode connected to a corresponding data line DL (e.g., a first data line DL1) of the plurality of data lines DL1 to DLm, and a drain electrode connected to corresponding ones of the liquid crystal capacitor CLC and the storage capacitor CST. That is, one end (e.g., one electrode) of each of the liquid crystal capacitor CLC and the storage capacitor CST is connected in parallel to the drain electrode of the thin film transistor TR. Another end (e.g., another electrode) of each of the liquid crystal capacitor CLC and the storage capacitor CST may be connected to a voltage (e.g., a common voltage).

The driving unit 120 includes a timing controller 122, a gate driver 124, and a data driver 126. The timing controller 122 receives image signals RGB and control signals CTRL from the outside. The control signals CTRL include, for example, a vertical synchronous signal, a horizontal synchronous signal, a main clock signal, and a data enable signal. The timing controller 122 provides, to the data driver 126, a first control signal CONT1 and an image data signal DATA that is obtained by processing the image signal RGB according to the operation conditions of the display panel 110 based on the control signals CTRL. The timing controller 122 provides a second control signal CONT2 to the gate driver 124. The first control signal CTRL1 may include a horizontal synchronous signal, a clock signal, and/or a line latch signal, and the second control signal CTRL2 may include a vertical synchronous start signal STV, an output enable signal, and/or a gate pulse signal. The timing controller 122 may output various image data signals DATA according to the arrangement of the pixels PX of the display panel 110 and a display frequency. The timing controller 122 provides, to the backlight unit 130, a backlight control signal CONT3 for controlling the backlight unit 130.

The gate driver 124 drives the gate lines GL1 to GLn in response to the second control signal CTRL2 from the timing controller 122. The gate driver 124 may include a gate driving integrated circuit (IC). The gate driver 124 may also be implemented as a circuit that uses an oxide semiconductor, an amorphous semiconductor, a crystalline semiconductor, a polycrystalline semiconductor, etc.

The gate driver 124 generates gate signals based on the second control signal CONT2 received from the timing controller 122, and outputs the gates signals to the plurality of gate lines GL1 to GLn.

The data driver 126 outputs gamma voltages for driving the data lines DL1 to DLm, in response to the image data signal DATA and the first control signal from the timing controller 122.

The gamma voltages may include positive-polarity data voltages having positive values and/or negative-polarity data voltages having negative values with respect to the common voltage. Some of the data voltages applied to the data lines DL1 to DLm for each of the horizontal sections HP may have positive polarity and others may have negative polarity. The polarity of the gamma voltages may be reversed according to frame sections to prevent or reduce the degradation of a liquid crystal. The data driver 126 may generate reversed data voltages in units of a frame section in response to a reversal signal.

The backlight unit 130 is located under the display panel 100 to face the pixels PX. In another embodiment, the backlight unit 130 may be located at a side (e.g., one side) of the display panel 110. The backlight unit 130 operates in response to the backlight control signal CONT3 from the timing controller 122. The backlight control signal CONT3 may include information corresponding to the number of fields in one frame section.

Figure 2:
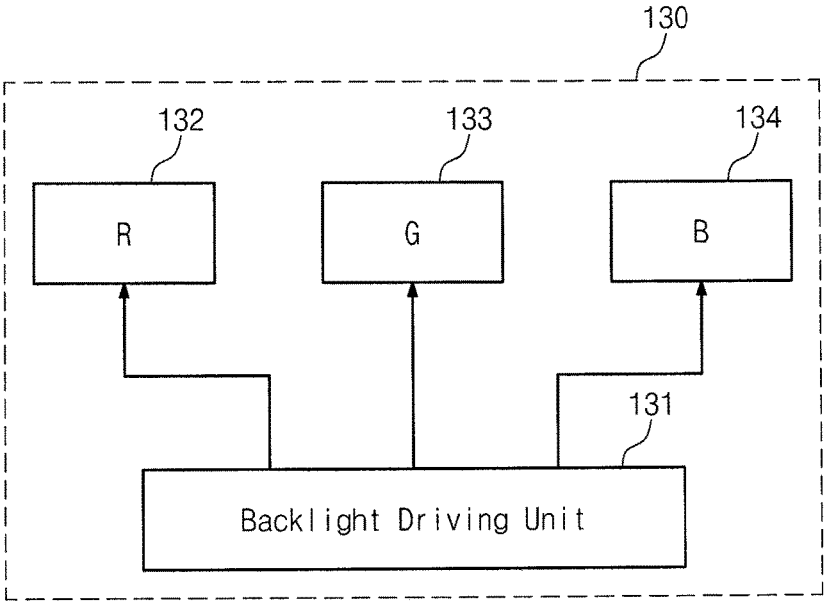
FIG. 2 illustrates a configuration of a backlight unit in FIG. 1.

FIG. 2 illustrates a configuration of the backlight unit in FIG. 1.

Referring to FIG. 2, the backlight unit 130 includes a backlight driving unit (e.g., a backlight driver) 131, a red light source 132, a green light source 133, and a blue light source 134. Each of the red light source 132, the green light source 133, and the blue light source 134 may include a plurality of light emitting diodes (LEDs). The backlight driving unit 131 may control the lighting (e.g., the light emission) of each of the red light source 132, the green light source 133, and the blue light source 134. The backlight driving unit 131 may perform single light emission that sequentially turns on the red light source 132, the green light source 133, and the blue light source 134, or mixed light emission that concurrently (e.g., simultaneously) turns on two or more of the light sources.

Figure 3:
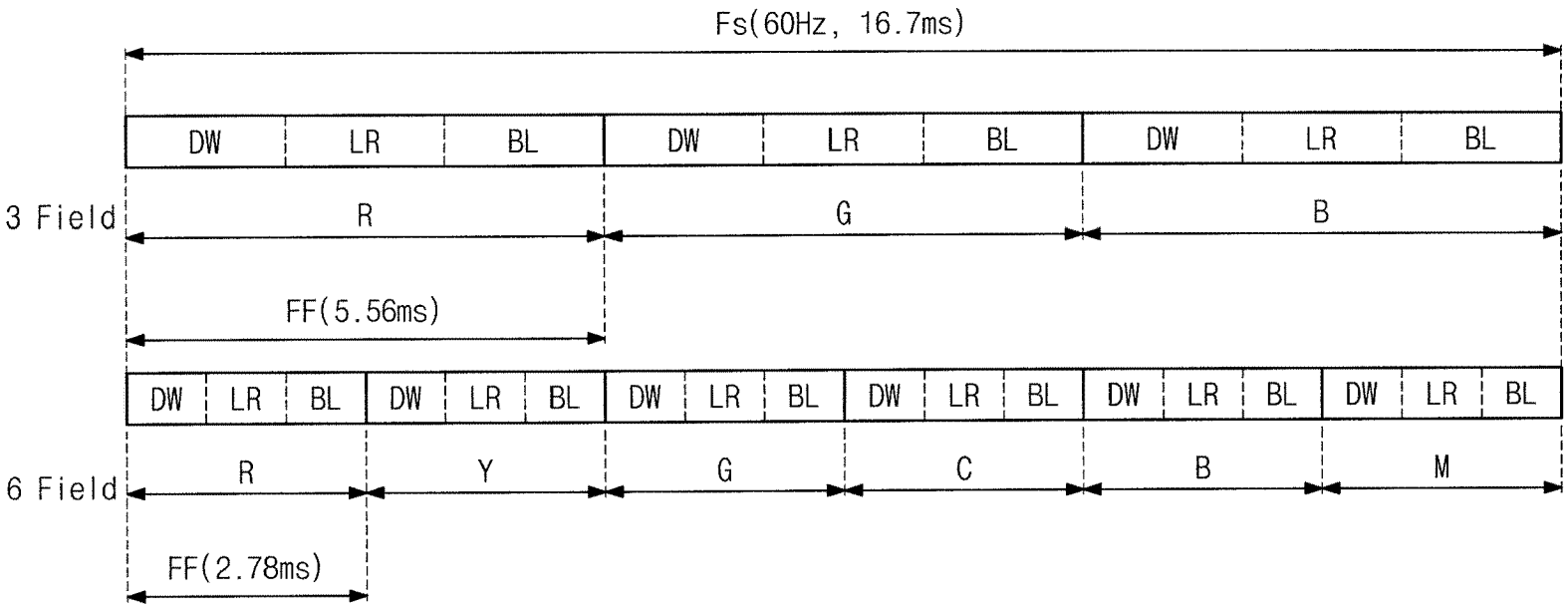
FIG. 3 is a diagram illustrating a field sequential color driving technique of the display device in FIG. 1.

FIG. 3 is a diagram illustrating a field sequential color driving technique of the display device in FIG. 1. FIG. 4 is a table illustrating a liquid crystal response time according to the number of fields in the filed sequential color driving technique through control of red, green, and blue light sources in FIG. 3.

Referring to FIGS. 2 to 4, the field sequential color driving technique may include a plurality of fields FF in one frame section Fs. For one field section FF, the red light source 132, the green light source 133, and the blue light source 134 may perform single or mixed light emission. For example, when the red light source 132, the green light source 133, and the blue light source 134 are sequentially turned on once for one frame section Fs, the number of fields FF is three. When the number of times that the red light source 132, the green light source 133, and the blue light source 134 performs single or mixed light emission for one frame section Fs is six, the number of fields FF is six.

The backlight unit 130 may enable the red light source 132, the green light source 133, and the blue light source 134 to perform mixed light emission to emit yellow Y, cyan C, magenta M, and/or black K.

Each of the fields FF includes a data writing time DW, a liquid crystal response time LR, and a backlight driving time BL. The data writing time DW includes the gate on time of the gate signals G1 to Gn that are sequentially applied to the gate lines GL1 to GLn of the display panel 110, and corresponds to one horizontal period 1H Time. The backlight driving time BL includes a time during which each of the red light source 132, the green light source 133, and the blue light source 134 is turned on.

For example, when the frequency of one frame section Fs is about 60 Hz and the number of fields in the single frame section Fs is three, the minimum driving frequency of each field is about 180 Hz. When the number of fields is five, the minimum driving frequency of each field is about 300 Hz. As the number of fields increases and the colors emitted from the backlight unit 130 are varied, such as yellow, cyan, magenta, and/or black, in addition to red, green, and blue, the color separation of the display device 100 may decrease and distortion in expression of mixed colors may be improved. However, when the number of fields increases, one field period shortens, and thus, a desired liquid crystal response time LR decreases.

For example, when the number of fields in one frame section Fs is three, a period of the field FF is about 5.56 ms (=1÷60÷3). When it is assumed that the backlight driving time BL in one field FF section is about 1 ms, the liquid crystal response time LR of the liquid crystal capacitor CLC in FIG. 1 is about 4.56 ms. When the number of fields in one frame section Fs is 4, 5, and 6, the liquid crystal response time LR is calculated by using the above method, as shown in FIG. 4.

The liquid crystal response time LR of the liquid crystal capacitor CLC may be sensitive to an ambient temperature, and accordingly, may react according to the ambient temperature. When the ambient temperature is low, the actual liquid crystal response time may be longer than the liquid crystal response time LR in FIG. 4. For example, when the number of fields in one frame section Fs is four, the liquid crystal response time LR of each field FF is 3.17 ms. However, when the actual liquid crystal response time of the liquid crystal capacitor CLC is longer than a desired liquid crystal response LR of 3.17 ms corresponding to a decrease in ambient temperature, color reproduction decreases, and thus, the quality of a display image decreases.

According to one or more embodiments of the inventive concept, the display device 100 may change the number of fields in one frame section Fs according to the ambient temperature, to prevent or substantially prevent a decrease in quality of a display image.

Figure 5:
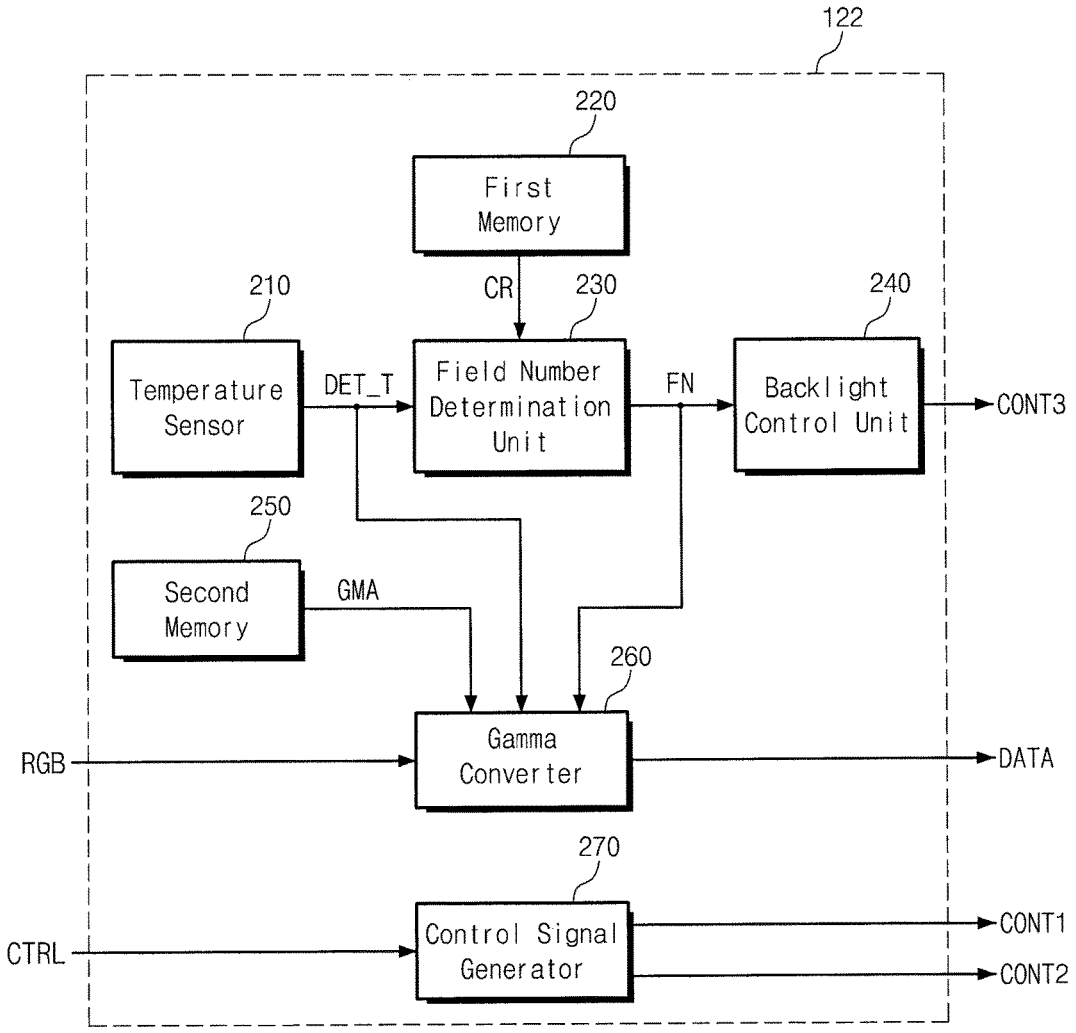
FIG. 5 is a block diagram illustrating a configuration of a timing controller in FIG. 1.

FIG. 5 is a block diagram illustrating a configuration of the timing controller in FIG. 1.

Referring to FIG. 5, the timing controller 122 includes a temperature sensor 210, memory (e.g., 220 and 250), a field number determination unit (e.g., a field number determinator) 230, a backlight control unit (e.g., a backlight controller) 240, a gamma converter 260, and a control signal generator 270. The memory includes a first memory 220 and a second memory 250. In the example in FIG. 5, the memory is divided into the first memory 220 and the second memory 250, but the inventive concept is not limited thereto, and the first and second memory 220 and 250 may be implemented as a single memory.

The temperature sensor 210 senses an ambient temperature, and outputs a temperature signal DET_T corresponding to the sensed temperature. The first memory 220 stores a liquid crystal response time CR corresponding to the ambient temperature.

The field number determination unit 230 reads the liquid crystal response time CR from the first memory 220 corresponding to the temperature signal DET_T, and determines the number of fields corresponding to the liquid crystal response time CR. The field number determination unit 230 outputs a field number signal FN corresponding to the determined number of fields.

The backlight control unit 240 outputs a backlight control signal CONT3 corresponding to the field number signal FN. The backlight control signal CONT3 is provided to the backlight unit 130 in FIG. 1.

The second memory 250 stores a gamma signal GMA corresponding to the ambient temperature. The gamma converter 260 receives the temperature signal DET_T from the temperature sensor 210, and the field number signal FN from the field number determination unit 230. The gamma converter 260 reads the gamma signal GMA from the second memory 250 corresponding to the temperature signal DET_T and the field number signal FN, and converts an image signal RGB received from the outside into an image data signal DATA corresponding to the gamma signal GMA. The image data signal DATA is provided to the data driver 126 in FIG. 1.

The control signal generator 270 receives a control signal CTRL from the outside, and generates a first control signal CONT1 and a second control signal CONT2. The first control signal CONT1 is provided to the data driver 126 in FIG. 1, and the second control signal CONT2 is provided to the gate driver 124 in FIG. 1.

FIG. 6 is a table illustrating a liquid crystal response time stored in the first memory in FIG. 5 corresponding to an ambient temperature.

Referring to FIGS. 1, 5, and 6, the liquid crystal capacitor CLC varies in liquid crystal response time CR according to the ambient temperature. The first memory 220 may include a lookup table that stores the liquid crystal response time CR of the liquid crystal capacitor CLC according to the ambient temperature. In the example in FIG. 6, the first memory 220 stores the liquid crystal response time CR at intervals of 2° C., but the temperature interval may include any suitable interval. Also, the values of the liquid crystal response time CR of the liquid crystal capacitor CLC corresponding to the ambient temperature may be determined by using the results of various suitable tests performed on the liquid crystal capacitor CLC. Accordingly, the values shown in FIG. 6 are only exemplary, and the present inventive concept is not limited thereto.

Figure 7:
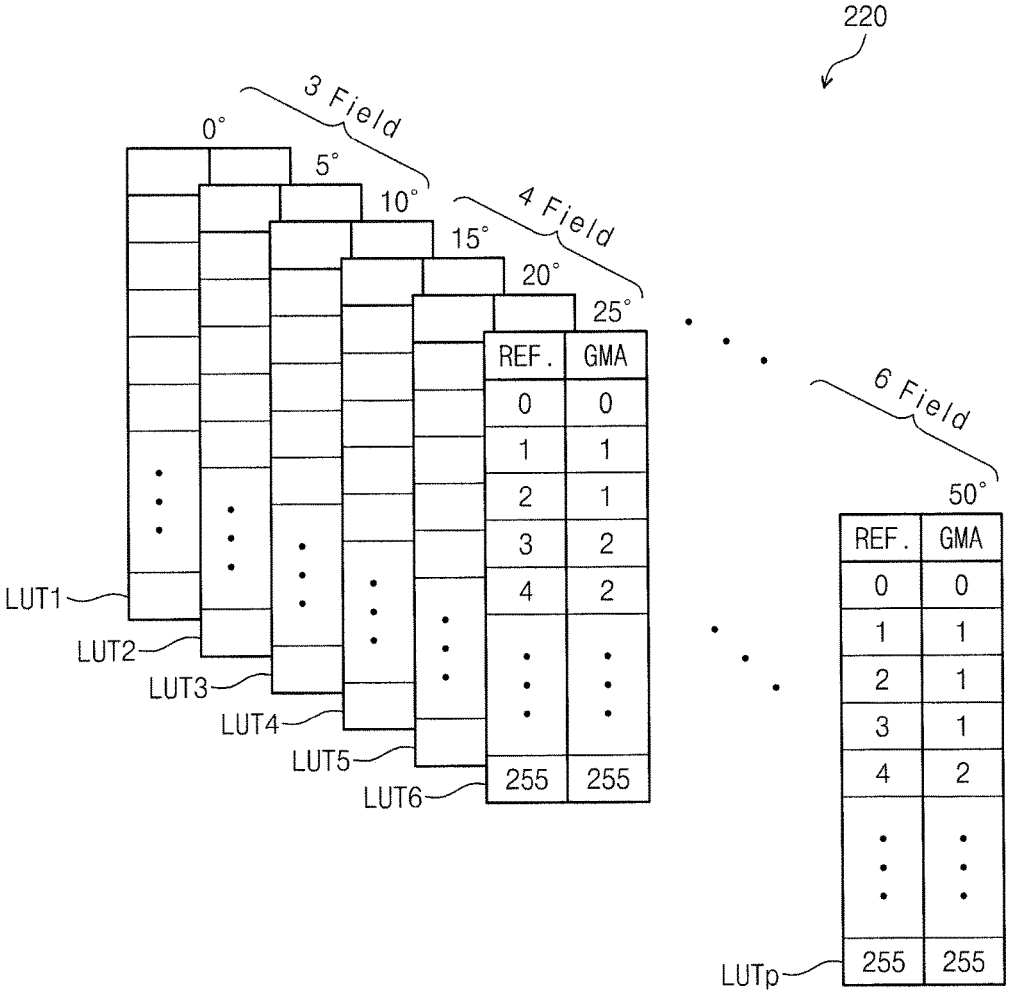
FIG. 7 illustrates tables of a gamma signal according to an ambient temperature and the number of fields that is stored in a second memory in FIG. 5.

FIG. 7 illustrates tables of a gamma signal according to an ambient temperature and the number of fields that is stored in a second memory in FIG. 5.

Referring to FIGS. 5 and 7, the second memory 250 includes a plurality of look-up tables LUT1 to LUTp for storing the gamma signal GMA according to the ambient temperature and the number of fields. Each of the plurality of look-up tables LUT1 to LUTp may store the gamma signal GMA corresponding to a different ambient temperature.

For example, the gamma converter 260 reads the gamma signal GMA of the lookup table LUTE from the second memory 250, when a field number signal FN is four and a temperature signal DET_T corresponds to 25° C., and converts an image signal RGB into an image data signal DATA corresponding to the gamma signal GMA.

Figure 8:
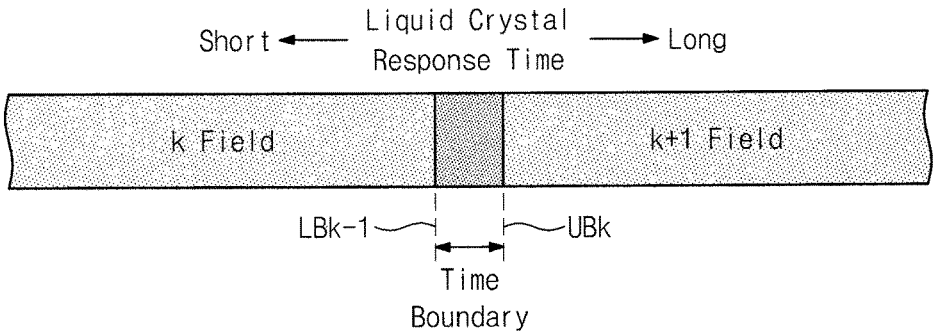
FIG. 8 is a diagram illustrating a method for changing the number of fields corresponding to a variation in liquid crystal response time according to an ambient temperature.

FIG. 8 is a diagram illustrating a method for changing the number of fields corresponding to a variation in liquid crystal response time according to an ambient temperature.

Referring to FIGS. 5 and 8, the field number determination unit 230 reads a liquid crystal response time CR corresponding to a temperature signal DET_T from the first memory 220, and determines the number of fields corresponding to the liquid crystal response time CR. When the liquid crystal response time CR read from the first memory 220 exceeds a time boundary range, the number of fields is changed. For example, when the current number of fields is k and the liquid crystal response time CR read from the first memory 220 is longer than a upper time boundary value UBk corresponding to the current number of fields, the field number determination unit 230 changes the number of fields to k+1. If the current number of fields is k+1 and the liquid crystal response time read from the first memory 220 is shorter than a lower time boundary value LBk+1 corresponding to the current number of fields, the field number determination unit 230 changes the number of fields to k.

The ambient temperature is not maintained at a fixed level, and may vary linearly or around a specific temperature. For example, when the ambient temperature is repetitively changed to 25° C., 26° C., and 25° C. for a short time, the number of fields is changed from 4 to 5 and then back from 5 to 4. When the number of fields is frequently changed for a short time, a user may recognize a variation in image. According to one or more embodiments of the inventive concept, when the liquid crystal response time CR varies, the field number determination unit 230 may delay a change in the number of fields according to a time boundary range (e.g., UBk to LBk+1) to prevent or substantially prevent a decrease in quality of a display image.

Figure 9:
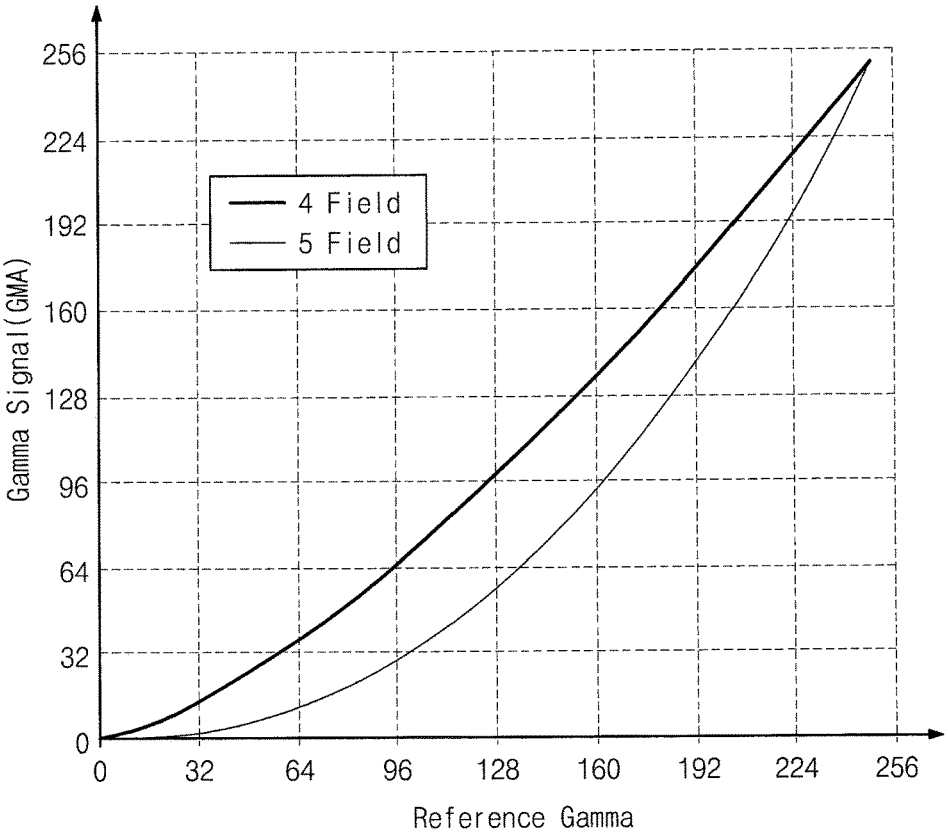
FIG. 9 illustrates a variation in gamma signal according to the change in number of fields.

FIG. 9 illustrates a variation in gamma signal according to a change in number of fields.

Referring to FIGS. 5 and 9, it is shown that a gamma curve when the number of fields determined by the field number determination unit 230 is four is different from a desired (e.g., an optimal) curve when the number of fields is five. That is, a gamma signal GMA for the reference gamma has a different value according to the number of fields. The gamma converter 260 may read the gamma signal GMA with reference to different lookup tables of the second memory 250 according to the number of fields determined by the field number determination unit 230.

Figure 10:
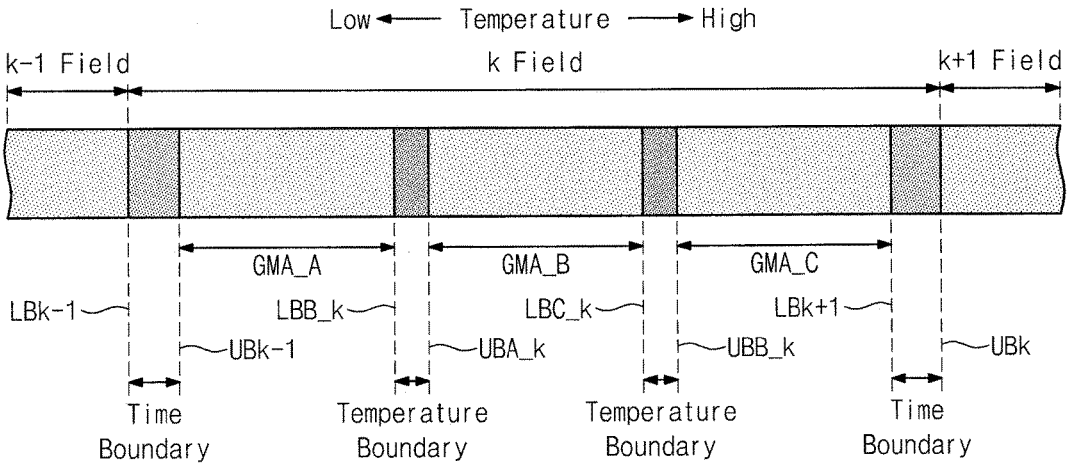
FIG. 10 is a diagram illustrating a method for changing a gamma signal corresponding to a variation in liquid crystal response time according to an ambient temperature, when the number of fields determined by a field number determination unit in FIG. 5 is the same.

FIG. 10 is a diagram illustrating a method for changing a gamma signal corresponding to a variation in liquid crystal response time according to an ambient temperature, when the number of fields determined by the field number determination unit in FIG. 5 is the same.

Referring to FIGS. 5 and 10, the gamma converter 260 reads a gamma signal GMA corresponding to a temperature signal DET_T and a field number signal FN from the second memory 250 when a variation in temperature corresponding to the temperature signal DET_T exceeds a temperature boundary range, and the gamma converter converts an image signal RGB into an image data signal DATA with reference to the gamma signal GMA.

For example, when the current number of fields is k and the temperature is A, the gamma converter 260 reads the gamma signal GMA from a lookup table corresponding to a gamma curve GMA_A in the second memory 250. When the ambient temperature becomes higher than an upper temperature boundary value UBA_k corresponding to the current gamma curve GMA_A, the gamma converter 260 reads a gamma signal GMA from a lookup table that stores a gamma curve GMA_B corresponding to the number of fields of k and temperature B, from the second memory 250.

When the ambient temperature becomes lower than a lower temperature boundary value LBB_k corresponding to the current gamma curve GMA_B, the gamma converter 260 reads a gamma signal GMA from a lookup table that stores a gamma curve GMA_A corresponding to the number of fields of k and temperature A, from the second memory 250.

Figure 11:
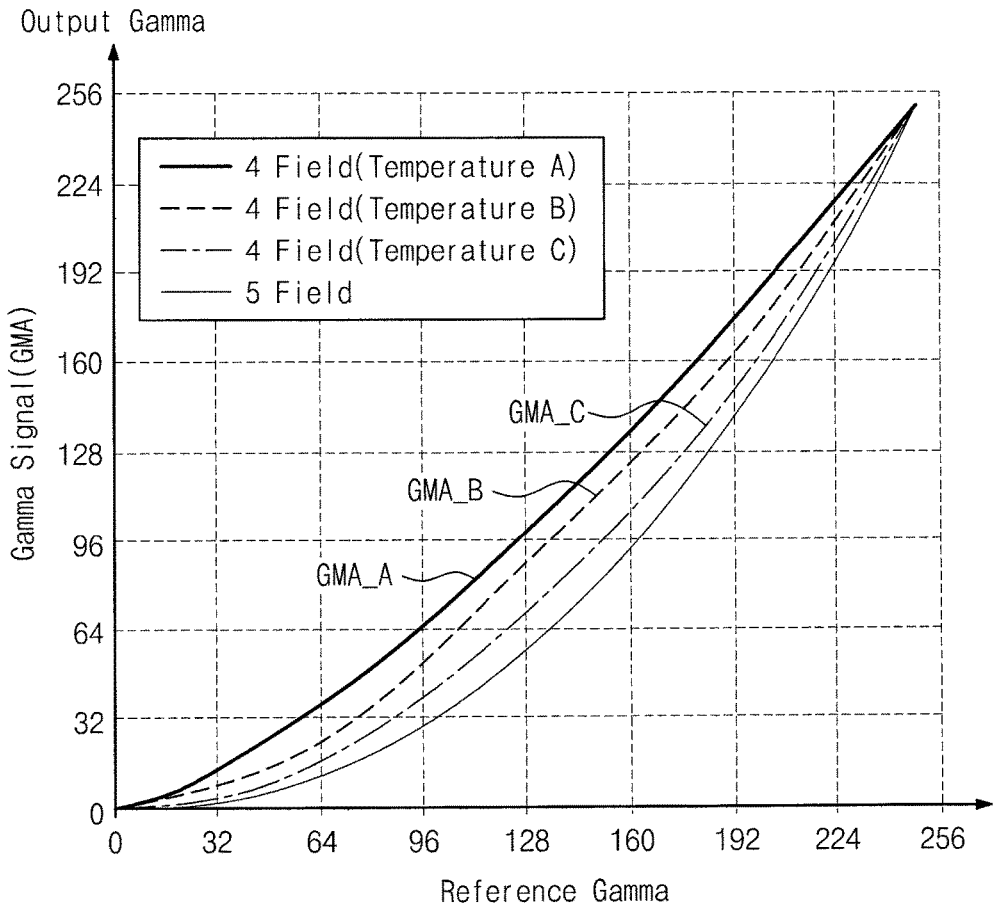
FIG. 11 illustrates a variation in gamma signal by a variation in liquid crystal response time according to an ambient temperature while the number of fields is equally maintained.

FIG. 11 illustrates a variation in gamma signal by a variation in liquid crystal response time according to an ambient temperature while the number of fields is equally maintained.

Referring to FIGS. 5 and 11, when the number of fields is four and the ambient temperatures are A, B, and C, the gamma signal GMA has different gamma curves GMA_A, GMA_B, and GMA_C. Thus, it is possible to further enhance the quality of a display image by converting an image signal RGB into an image data signal DATA by using different gamma curves according to the ambient temperature, even when the number of fields is the same.

The pixels PX arranged on the display panel 110 in FIG. 1 may vary in ambient temperature according to their positions. In this case, the timing controller 122 may enable the pixels to be driven with a different number of fields according to the positions of the pixels PX.

The timing controller according to one or more embodiments of the inventive concept may determine the number of fields according to the ambient temperature, and may convert an image signal into an image data signal with reference to a gamma signal corresponding to the ambient temperature and the determined number of fields, to provide the image data signal to the display panel. Thus, it is possible to enhance display quality by decreasing the number of fields in one frame when a liquid crystal response time is increased corresponding to a decrease in ambient temperature. Also, since it is possible to perform gamma correction according to the number of fields in one frame and the ambient temperature, the display device may display an image with increased or optimal quality.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or"

includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

While example embodiments are described above, a person having ordinary skill in the art may understand that various modifications may be made therein, without departing from the spirit and scope of the inventive concept as defined in the following claims and their equivalents. Therefore, it is to be understood that the foregoing is illustrative of various example embodiments, and the present inventive concept is not to be construed as limited to the specific example embodiments disclosed herein. Thus, various suitable modifications to the disclosed example embodiments, as well as other example embodiments, are intended to be included within the spirit and scope of the appended claims and their equivalents.

What is claimed is:

1. A timing controller comprising:

a temperature sensor configured to sense an ambient temperature;

a memory configured to store a liquid crystal response time corresponding to the ambient temperature, and a gamma signal corresponding to the ambient temperature;

a field number determinator configured to identify the liquid crystal response time corresponding to the ambient temperature from the memory, and to determine a number of fields in one frame section corresponding to the liquid crystal response time; and a gamma converter configured to identify the gamma signal corresponding to the ambient temperature and the number of fields from the memory, and to convert an image signal into an image data signal corresponding to the gamma signal.

2. The timing controller of claim 1, wherein the memory comprises:

a first memory configured to store the liquid crystal response time corresponding to the ambient temperature; and a second memory configured to store the gamma signal corresponding to the ambient temperature.

3. The timing controller of claim 1, wherein the temperature sensor is configured to sense the ambient temperature at a time interval.

4. The timing controller of claim 3, wherein the field number determinator is configured to change the number of fields, when a variation of the liquid crystal response time identified from the memory exceeds a time boundary range.

5. The timing controller of claim 3, wherein the field number determinator is configured to change the number of fields to k+1, when a current number of fields is k and the liquid crystal response time identified from the memory is longer than an upper time boundary value corresponding to the current number of fields.

6. The timing controller of claim 3, wherein the field number determinator is configured to change the number of fields to k, when a current number of fields is k+1and the liquid crystal response time identified from the memory is shorter than a lower time boundary value corresponding to the current number of fields.

7. The timing controller of claim 3, wherein the gamma converter is configured to identify the gamma signal corresponding to the ambient temperature and the number of fields from the memory, and to convert the image signal into the image data signal corresponding to the gamma signal, when a variation in the ambient temperature exceeds a temperature boundary range.

8. The timing controller of claim 3, wherein the gamma converter is configured to identify the gamma signal corresponding to the ambient temperature and the number of fields from the memory, and to convert the image signal into the image data signal corresponding to the gamma signal, when the ambient temperature becomes higher than an upper temperature boundary value corresponding to a current gamma signal.

9. The timing controller of claim 3, wherein the gamma converter is configured to identify the gamma signal corresponding to the ambient temperature and the number of fields from the memory, and to convert the image signal into the image data signal corresponding to the gamma signal, when the ambient temperature becomes lower than a lower temperature boundary value corresponding to a current gamma signal.

10. The timing controller of claim 1, further comprising a backlight controller configured to output a backlight control signal for controlling a backlight source in response to the number of fields.

11. A display device comprising:

a display panel;

a driver configured to receive an image signal and a control signal, to convert the image signal into a data signal to enable an image to be displayed on the display panel, and to output a backlight control signal; and a backlight source configured to provide light to the display panel in response to the backlight control signal, wherein the driver comprises a timing controller, and the timing controller comprises:

a temperature sensor configured to sense an ambient temperature;

a memory configured to store a liquid crystal response time corresponding to the ambient temperature, and a gamma signal corresponding to the ambient temperature;

a field number determinator configured to identify the liquid crystal response time corresponding to the ambient temperature from the memory, and to determine a number of fields in one frame section corresponding to the liquid crystal response time; and a gamma converter configured to identify the gamma signal corresponding to the ambient temperature and the number of fields from the memory, and to convert the image signal into an image data signal corresponding to the gamma signal.

12. The display device of claim 11, wherein the memory comprises:

a first memory configured to store the liquid crystal response time corresponding to the ambient temperature; and a second memory configured to store the gamma signal corresponding to the ambient temperature.

13. The display device of claim 11, wherein the field number determinator is configured to change the number of fields, when a variation of the liquid crystal response time identified from the memory exceeds a time boundary range.

14. The display device of claim 11, wherein the gamma converter is configured to identify the gamma signal corresponding to the ambient temperature and the number of fields from the memory, and to convert the image signal into the image data signal corresponding to the gamma signal, when a variation in ambient temperature exceeds a temperature boundary range.

15. The display device of claim 11, wherein the timing controller further comprises a backlight controller configured to output the backlight control signal for controlling the backlight source in response to the number of fields.

16. The display device of claim 11, wherein the display panel comprises a plurality of sub pixels connected to a plurality of gate lines and to a plurality of data lines, wherein the driver further comprises:

a gate driver configured to drive the plurality of gate lines; and a data driver configured to drive the plurality of data lines.

17. The display device of claim 16, wherein the timing controller is configured to:

output a first control signal and a second control signal in response to the control signal; and provide the image signal and the first control signal to the data driver, and the second control signal to the gate driver.

18. A method of driving a display device comprising a display panel, the method comprising:

sensing an ambient temperature;

storing, in a memory, a liquid crystal response time corresponding to the ambient temperature, and a gamma signal corresponding to the ambient temperature;

identifying the liquid crystal response time corresponding to the ambient temperature from the memory;

determining a number of fields in one frame section corresponding to the liquid crystal response time;

identifying the gamma signal corresponding to the ambient temperature and the number of fields from the memory; and converting an image signal into an image data signal corresponding to the gamma signal, to provide the image data signal to the display panel.

19. The method of claim 18, wherein the display device further comprises a backlight source, and the method further comprises outputting a backlight control signal for controlling the backlight source in response to the number of fields.

* * * * *